United States Patent [19]

Kluessendorf

[11] Patent Number: 4,622,532

[45] Date of Patent: Nov. 11, 1986

[54] HOURGLASS MAGNET

[75] Inventor: Timothy J. Kluessendorf, Racine, Wis.

[73] Assignee: Magnetics International, Inc., Cudahy, Wis.

[21] Appl. No.: 724,323

[22] Filed: Apr. 17, 1985

[51] Int. Cl.[4] ..... H01F 7/20

[52] U.S. Cl. ..... 335/292; 335/300

[58] Field of Search ..... 335/282, 296, 299, 300, 335/292

[56] References Cited

U.S. PATENT DOCUMENTS

| | | | |
|---|---|---|---|
| 2,095,499 | 10/1937 | Hodgson et al. | 335/292 |
| 3,763,453 | 10/1973 | Schurr | 335/292 |
| 4,045,756 | 8/1977 | Mueller | 335/292 |

*Primary Examiner*—George Harris

*Attorney, Agent, or Firm*—Wood, Dalton, Phillips, Mason, & Rowe

[57] ABSTRACT

The invention is intended for incorporation into an enclosure confining fluid about an electromagnet of the type having a core, at least one coil disposed about the core and a current source coupled to the coil to establish a magnetic field. According to the invention, at least a portion of the peripheral wall of the enclosure surrounding the core axis resides in non-parallel relationship with the axis of the core. As a result, a part of the peripheral wall portion is in closer proximity to the wire coil than the remainder of the wall portion. As a result, the heat readily conducts through the wall portion and is dissipated efficiently. The surface exposed to the atmosphere with the above construction has a greater area than would a planar wall parallel to the core axis so that heat dissipation is enhanced.

8 Claims, 2 Drawing Figures

HOURGLASS MAGNET

BACKGROUND OF THE INVENTION

1. Field of the Invention

This invention relates to electromagnets with enclosures confining a cooling fluid and, more particularly, to an improved enclosure for the fluid which enhances heat dissipation.

2. Background Art

It is known to provide an enclosure about an electromagnet to confine fluid about coils associated with the magnet to cool and thereby extend the useful life of the magnet. It is known, for example, to provide a square enclosure about an electromagnet with a cylindrical core. Because the core may have a relatively small axial dimension, the surface area of the surrounding side walls exposed to the atmosphere may not be sufficient to effectively dissipate the generated heat.

SUMMARY OF THE INVENTION

The present invention is specifically directed to overcoming the above problem in a novel and simple manner.

The invention is intended for incorporation into an enclosure confining fluid about an electromagnet of the type having a core, at least one coil disposed about the core and a current source coupled to the coil to establish a magnetic field. According to the invention, at least a portion of the peripheral wall of the enclosure surrounding the core axis resides in non-parallel relationship with the axis of the core. A part of the peripheral wall portion is therefore in closer proximity to the coil than the remainder of the wall portion, causing the heat to be absorbed readily by the wall portion through conduction. The surface exposed to the atmosphere with the above construction has an exposed radiating surface area greater than a wall that is planar and parallel to the core axis so that heat dissipates to the surrounding atmosphere in a quick and efficient manner.

DETAILED DESCRIPTION OF THE DRAWINGS

Figure 1:
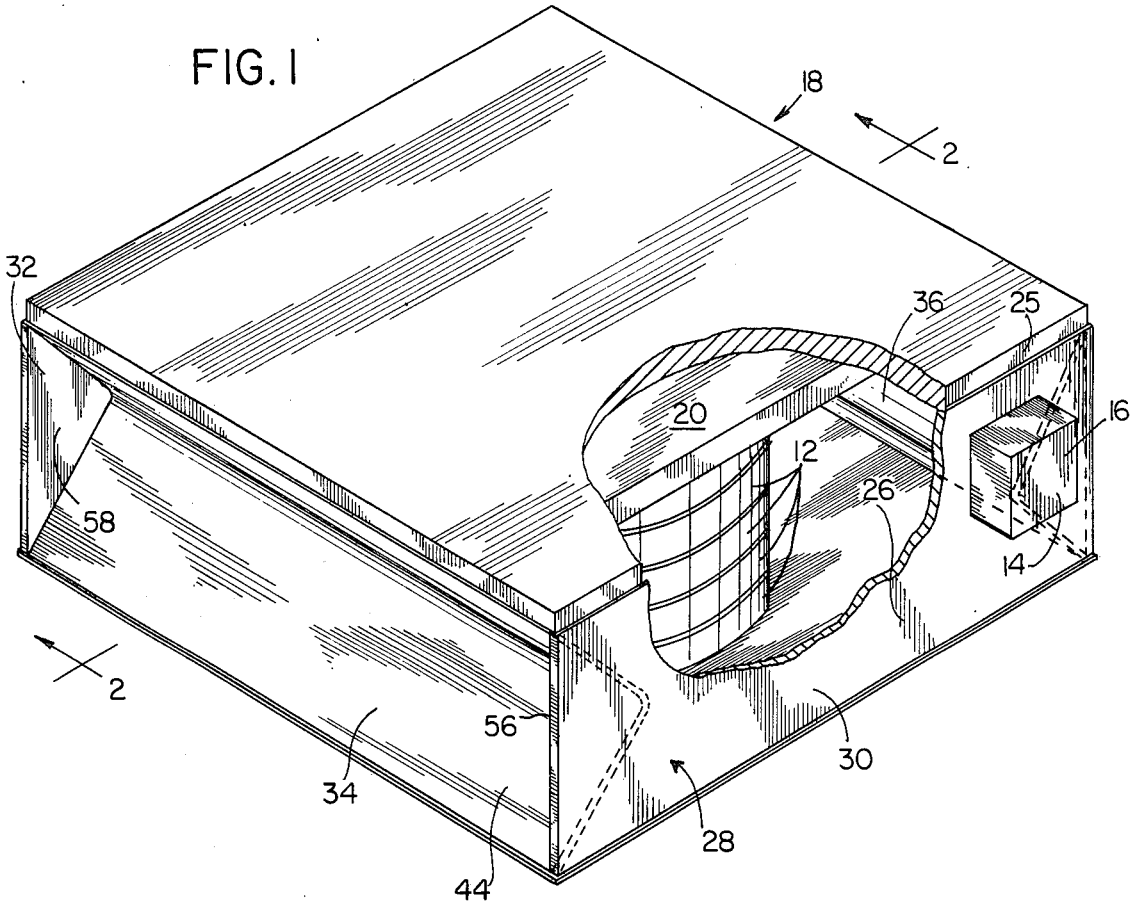
FIG. 1 is a perspective view of an electromagnet with an enclosure according to the present invention.
Figure 2:
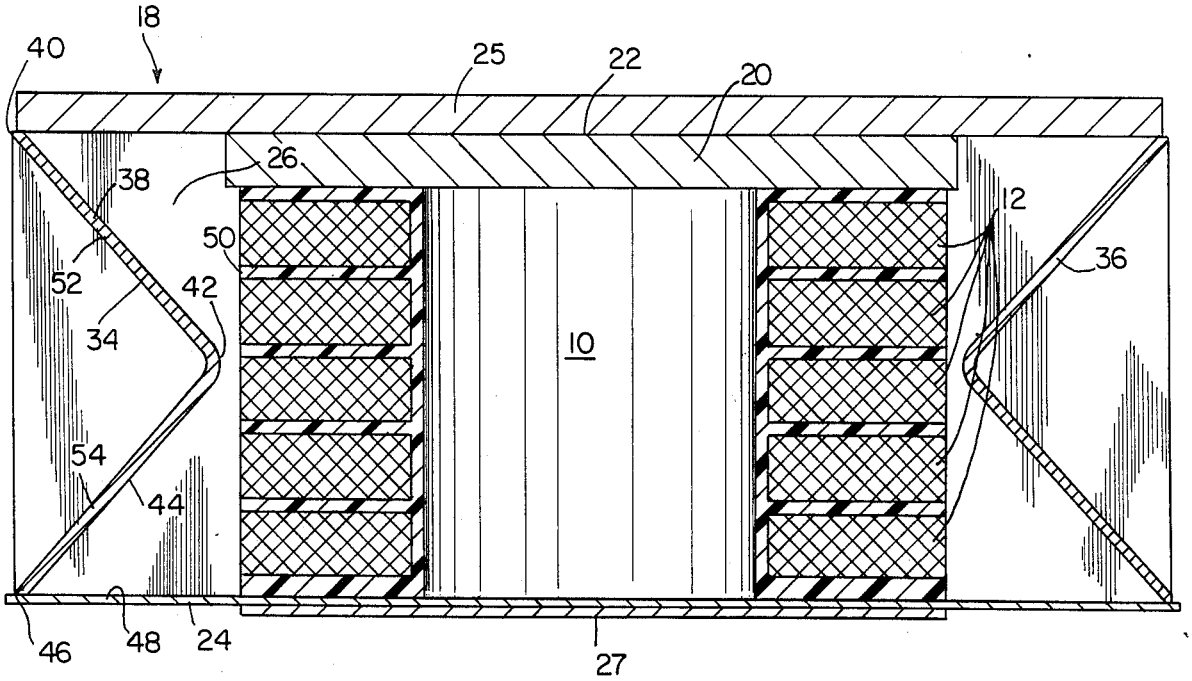
FIG. 2 is a sectional view of the electromagnet and enclosure along line 2—2 of FIG. 1.

The invention contemplates use with a conventional electromagnet of the type depicted in FIGS. 1 and 2. A cylindrically shaped, solid steel core 10 is surrounded by preferably from four to seven anodized, aluminum, annular strip coils 12. The coils are stacked to be axially coincident, connected in continuous manner and coupled to a current supply 14. An outlet box 16 is provided externally of an enclosure at 18 enveloping the core and coils. A flat steel headplate 20 seats facially against the upper surface of the core and overlaps the the coil diameter. The plate 20 spreads out the magnetic flux to prevent saturation. Immediately above the head plate and in facial engagement with the upper, planar surface 22 of the head plate is a steel top plate 25 which, in conjunction with a bottom plate 24 defines a unitary assembly bounding a chamber 26 within which cooling fluid is confined about the core and coils. Preferably, the bottom plate is non-magnetic stainless steel and welded directly to the bottom of the core. A steel impact plate 27 is centered on and welded to the bottom plate 24. The impact plate 27 protects the bottom plate 24 and creates an evenly distributed magnetic field and a marked increase in flux density over a like structure without the impact plate 27.

The invention resides in the peripheral side wall structure at 28 surrounding the axis of the core which, in conjunction with the top and bottom plates, defines the fluid tight enclosure 18. The top and bottom plates are substantially square so that the side wall structure 28 is defined by first and second pairs of facing side walls 30, 32 and 34, 36. In one form of the invention, each of the walls 30, 32 of the one side wall pair are planar and extend parallel to the axis of the core 10 and are welded conventionally to the top and bottom plates to establish a leakproof seal.

The walls 34, 36 may be identical to each other in construction. The side wall 34 will be described in detail to exemplify the construction of walls 34, 36. Each of the walls 34, 36 is formed from a single steel blank. Each wall is formed by bending a substantially rectangular plate lengthwise about its mid portion to, for instance, a right angle. The wall 34 is dimensioned so that the upper wall portion 38 extends angularly inwardly from the edge 40 of the top plate 25 towards the core to an apex 42 from where the bottom portion 44 is return bent so that the free edge 46 matches with the upper surface 48 of the bottom plate 24. The wall edges 40, 46 are welded respectively to the top and bottom plates. The dimensions of the top and bottom plates and the spacing therebetween is chosen so that the apex 42 of the wall 34 is spaced slightly from the outer peripheral surface 50 of the coils 12. The structure in vertical cross-section appears as an hourglass configuration. With the enclosure completed, a cooling fluid is introduced to fill the chamber 26.

It can be seen that, because of the close proximity of the apex 42 of the wall 34 to the coil, that the heat from the coil readily conducts through the cooling medium through the apex 42 and diagonally to wall portions 38, 44. The wall portions 38, 44 define flat surfaces 52, 54 respectively, which are exposed to the atmosphere. The combined area of the surfaces 52, 54, by reason of the bent wall design, is greater than the area would be if the wall was planar and extended parallel to the axis of the core between the top and bottom plates. Not only is the radiating surface area of the wall 34 increased, but triangular heat radiating surfaces 56, 58 of each wall 30, 32, formed at the overlap by walls 30, 32 of walls 34, 36, are exposed to the atmosphere to further enhance heat dissipation, whereas in a square, conventional construction the surfaces 56, 58 would be immersed in the cooling fluid. With the enclosure according to the invention, heat continually dissipates to the surrounding atmosphere in a quick and efficient manner.

The foregoing description was made for purposes of demonstrating the structure and operation of the present invention, with no unnecessary limitations to be understood therefrom.

I claim:

1. An improved enclosure for confining a cooling fluid about an electromagnet of the type having a core with a core axis, at least one coil disposed about the core and a current source coupled to the coil to establish a magnetic field, the improvement comprising:

at least a portion of a peripheral wall of the enclosure surrounding the core axis having a configuration that presents a substantially increased surface area to the cooling fluid and to the atmosphere than a comparable straight wall between a top and a bottom wall of the electromagnet, and said cooling fluid bathes the coil and the inside surface of the peripheral wall, whereby at least a part of the peripheral wall portion is in closer proximity to the coil than the remainder of the wall portion to enhance absorption and dissipation of heat therefrom.

2. The improved enclosure according to claim 1 wherein said peripheral wall portion in axial cross section comprises substantially a V-shape with the V opening radially away from the axis of the core.

3. The improved enclosure according to claim 1 wherein said enclosure comprises top and bottom plates at the axial ends of the core and first and second pairs of facing walls sealing between the plates, at least one said wall in one of the wall pairs directed from the top plate inwardly toward the core at least partially between the top and bottom plates.

4. The improved enclosure according to claim 1 wherein said enclosure comprises top and bottom plates at the axial ends of the core and first and second pairs of walls sealing between the plates, at least one said wall on one of the wall pairs directed from the top plate radially inwardly toward the core to an apex and returned radially outwardly from the core from the apex to the bottom plate.

5. An improved enclosure for confining a cooling fluid about an electromagnet of the type having a core with a core axis at least one coil disposed about the core and a current source coupled to the winding to establish a magnetic field, the improvement comprising:

said enclosure having substantially parallel, spaced top and bottom plates at the axial ends of the core and first and second pairs of sealing walls between the top and bottom plates, at least one said wall in one of the wall pairs having a heat dissipating surface exposed to the atmosphere with a non-planar configuration between the top and bottom plates; said non-planar configuration presenting an increased heat receiving surface to the cooling fluid and an increased heat dissipating surface to the atmosphere.

6. An improved enclosure for confining a cooling fluid about an electromagnet of the type having a cylindrical core, at least one coil disposed about the core and a current source coupled to the winding to establish a magnetic field, the improvement comprising:

top and bottom plates at the axial ends of the cylindrical core;

first and second facing wall pairs cooperatively sealing between the top and bottom plates;

the walls in one said wall pair each having at least a portion with a V-shape in axial cross-section, said V on each wall in the one wall pair opening away from the V on the other wall in the one wall pair, said V-shaped walls presenting an increased heat receiving surface to the cooling fluid and an increased heat dissipating surface to the atmosphere.

7. The improved enclosure according to claim 6 wherein a substantially flat head plate resides between the core and the top plate to spread out magnetic flux and prevent saturation.

8. The improved enclosure according to claim 6 wherein another of the walls overlaps the V and has a surface within the V exposed to the atmosphere to further enhance heat dissipation.

* * * * *